US009683420B2

(12) United States Patent
Skjold

(10) Patent No.: US 9,683,420 B2
(45) Date of Patent: Jun. 20, 2017

(54) METHOD OF WELL OPERATION

(71) Applicant: Interwell Technology AS, Ranheim (NO)

(72) Inventor: Michael Skjold, Jakobsli (NO)

(73) Assignee: INTERWELL P&A AS, Hafrsfjord (NO)

( * ) Notice: Subject to any disclaimer, the term of this patent is extended or adjusted under 35 U.S.C. 154(b) by 218 days.

(21) Appl. No.: 14/384,938

(22) PCT Filed: Mar. 8, 2013

(86) PCT No.: PCT/EP2013/054749
§ 371 (c)(1),
(2) Date: Sep. 12, 2014

(87) PCT Pub. No.: WO2013/135583
PCT Pub. Date: Sep. 19, 2013

(65) Prior Publication Data

US 2015/0034317 A1 Feb. 5, 2015

(30) Foreign Application Priority Data

Mar. 12, 2012 (NO) ..... 20120293

(51) Int. Cl.
*E21B 17/00* (2006.01)
*E21B 29/02* (2006.01)
(Continued)

(52) U.S. Cl.
CPC ..... *E21B 29/02* (2013.01); *E21B 17/00* (2013.01); *E21B 33/1204* (2013.01); *E21B 36/008* (2013.01)

(58) Field of Classification Search
None
See application file for complete search history.

(56) References Cited

U.S. PATENT DOCUMENTS 2,144,208 A 1/1939 Meter
2,286,075 A * 6/1942 Evans ..... B23K 23/00 164/54
(Continued)

FOREIGN PATENT DOCUMENTS

GB 2417265 A * 2/2006 ..... E21B 33/134
WO 2008/102119 A2 8/2008

OTHER PUBLICATIONS

International Search Report for corresponding International Application No. PCT/EP2013/054749, mailed Apr. 24, 2014 (3 pages).
(Continued)

*Primary Examiner* — Angela M DiTrani
(74) *Attorney, Agent, or Firm* — Osha Liang LLP

(57) ABSTRACT

Method and use of abandoning a well (2) or removing a well element (10) which is arranged in a well (2) by melting surrounding materials or by melting the well element (10), the method comprising the steps of; providing an amount of a heat generating mixture (6), the amount (6) being adapted to perform one of the desired operations, positioning the heat generating mixture (6) at a melting position in the well (2), igniting the heat generating mixture (6), thereby melting the surrounding materials in the well (2) or melting the well element (10).

10 Claims, 5 Drawing Sheets

(51) Int. Cl.
*E21B 33/12* (2006.01)
*E21B 36/00* (2006.01)

(56) References Cited

U.S. PATENT DOCUMENTS

| | | | | |
|---|---|---|---|---|
| 2,935,020 | A | 5/1960 | Howard et al. | |
| 4,024,916 | A * | 5/1977 | Hartley | E21B 43/2401 166/288 |
| 4,298,063 | A | 11/1981 | Regalbuto et al. | |
| 4,489,784 | A * | 12/1984 | Messenger | E21B 33/13 137/1 |
| 6,536,349 | B2 * | 3/2003 | Patterson | F42B 3/00 102/312 |
| 6,923,263 | B2 * | 8/2005 | Eden | C09K 8/42 166/179 |
| 9,228,412 | B2 * | 1/2016 | Lowry | E21B 33/13 |
| 9,394,757 | B2 * | 7/2016 | Lowry | E21B 36/008 |
| 2002/0170713 | A1 | 11/2002 | Haugen et al. | |
| 2003/0070812 | A1 | 4/2003 | Robertson | |
| 2005/0199307 | A1 | 9/2005 | Eden | |
| 2006/0037748 | A1 * | 2/2006 | Wardlaw | E21B 36/008 166/277 |
| 2006/0144591 | A1 * | 7/2006 | Gonzalez | E21B 29/10 166/277 |

OTHER PUBLICATIONS

Written Opinion for corresponding International Application No. PCT/EP2013/054749, mailed Apr. 24, 2014 (6 pages).
Search Report for Norwegian Application No. 20120293, mailed Oct. 12, 2012 (2 pages).

* cited by examiner

METHOD OF WELL OPERATION

CROSS-REFERENCE TO RELATED APPLICATIONS

This application is a National Stage application of International Patent Application No. PCT/EP2013/054749, filed on Mar. 8, 2013, which claims priority to Norwegian Application No. 20120293, filed on Mar. 12, 2012. Both priority applications are hereby incorporated by reference in their entirety.

FIELD OF THE INVENTION

The invention relates to a method for plugging and abandoning a well by melting the surrounding materials.

BACKGROUND OF THE INVENTION

To meet governmental requirements during plugging and abandonment (P&A) operations in a well, a deep set barrier must be installed as close to the potential source of inflow as possible, covering all leak paths. A permanent well barrier shall extend across the full cross section area of the well, including all annuli, and seal both vertically and horizontally in the well. This requires removal of tubing mechanically, or perforating tubulars followed by washing behind the tubulars. This will lead to that swarf and debris from for example mechanical milling, need to be cleaned out of all flowlines, including the BOP system, to the rig. Normally cement is used for the purpose of P&A operations. However, the well barrier has to comply with all of the following requirements for a P&A plug; a) impermeability, b) long term integrity, c) non shrinking, d) ductility (non brittle)—able to withstand mechanical loads or impact, e) resistance to different chemicals/substances (H2S, CO2 and hydrocarbons) and f) wetting—to ensure bonding to steel.

The applicant has invented an alternative method of performing P&A operations, using a heat generating mixture, e.g. a thermite mixture. Thermite is normally known as a pyrotechnic composition of a metal powder and a metal oxide. The metal powder and the metal oxide produce an exothermic oxidation-reduction reaction known as a thermite reaction. A number of metals can be the reducing agent, e.g. aluminium. If aluminium is the reducing agent, the reaction is called an aluminothermic reaction. Most of the varieties are not explosive, but may create short bursts of extremely high temperatures focused on a very small area for a short period of time. The temperatures may reach as high as 3000° C.

There exist prior art solutions where thermite is used within the field of well technology. Examples are disclosed in documents US 2006/144591 A1 (Gonzalez et al.) and U.S. Pat. No. 6,923,263 B2 (Eden et al.). US 2006/144591 A1 describes the use of molten metal plugs in wells. The object of US 2006/144591 A1 is to melt a meltable repair material, such as an eutectic material, utilizing an exothermic reactant material. The method disclosed comprises introducing a meltable repair material proximate a structure in a subterranean well where a fluid seal is desired. Exothermic reactant materials are located proximate the meltable repair material. The exothermic reactant is ignited or otherwise initiated to create an exothermic reaction which supplies heat to and melts the meltable repair material into a molten mass. The molten mass flows and solidifies across the structure and the fluid seal defect to effect a fluid seal in the subterranean well structure. Suitable exothermic reactant materials exemplified includes thermite, thermate and highly exothermic chemical reactions such as the reaction between ammonium chloride and sodium nitrite, while preferred meltable materials include solder and eutectic metals which expand upon cooling and solidifying from a molten state.

U.S. Pat. No. 6,923,263 B2 discloses an apparatus for forming a plug in a casing including a body of plug material and a carrier for insertion into a casing. The carrier supports the body of plug material. The carrier includes a mandrel and at least two circular flanges spaced apart along the mandrel. The carrier also includes a heater for heating the mandrel. The mandrel is heated to a temperature above the melting point of the material in the mandrel and the plug material slumps into the at least two circular flanges. The at least two circular flanges force the expanded solidifying plug against the casing which aids the transfer of heat between the mandrel and the plug material, and resists creep of solidified material along the casing.

Other prior art solutions are known from documents US 2002/170713 A1 and U.S. Pat. No. 4,298,063 A.

A common feature in the disclosed prior art solutions is that the metal plug material is introduced in to the well. Additionally, the plug is formed substantially on the inside of a tubular, such as a casing or tubing, forming a metal seal on the inside of said tubular. Therefore, the melting point of the introduced plug material has to be lower than the melting point of the surrounding tubular to avoid that the surrounding tubular melts.

An object of the invention is to provide a method for permanent well abandonment or removal of a well element arranged in a well by the use of a thermite mixture.

Another object of the invention is to reduce or remove the need for a rig in P&A operations.

SUMMARY OF THE INVENTION

The invention is set forth and characterized in the independent claims, while the independent claims describe other characteristics of the invention.

The invention relates to a method of abandoning a well by melting surrounding materials, such as pipes, cement and formation sand, the method comprising the steps of;

- providing an amount of a heat generating mixture, the amount being adapted to perform the desired operation,
- positioning the heat generating mixture at a desired position in the well,
- igniting the heat generating mixture, thereby melting the surrounding materials in the well.

It is further described a method of removing a well element which is arranged in a well by melting the well element, the method comprising the steps of;

- providing an amount of a heat generating mixture, the amount being adapted to perform the desired operation,
- positioning the heat generating mixture at a desired position in the well,
- igniting the heat generating mixture, thereby melting the well element.

After ignition, a heat generating mixture, e.g. a thermite mixture or other mixture, will burn with a temperature of up to 3000° C. and melt a great part of the proximate surrounding materials, with or without the addition of any additional metal or other meltable materials to the well. The surrounding materials may include any material normally present in the well, such as tubulars, e.g. casing, tubing and liner, cement, formation sand, etc. The heat from the ignited mixture will melt a sufficient amount of said materials. When the heat generating mixture has burnt out, the melted materials will solidify forming a seal, e.g. a plug, comprising melted metal, cement, formation sand, etc. against the well formation. The operation is particularly suitable in vertical sections of the well, but may also be suitable in deviating or diverging sections such as horizontal sections or sections differing from a vertical section.

The sufficient amount of heat generating mixture, e.g. thermite mixture, varies dependent on which operation that is to be performed as well as the design well path. As an example, NORSOK standard D-010, which relates to well integrity in drilling and well operations, defines that a cement plug shall be at least 50 meters and in some operations up to 200 meters when used in abandonment operations. For example, one may fill whole of the inner volume of the pipe. In the embodiment regarding well abandonment, a pipe having an inner diameter of 0.2286 m (9⅝") has a capacity of 0.037 $m^3$ per meter pipe. In order to provide a 50 meter plug by means of the method according to the invention, one would need 1.85 $m^3$ heat generating mixture comprising thermite. Similarly, if a cement plug of 200 meters is required, the amount of heat generating mixture needed would be 3.4 $m^3$. It should though be understood that other plug dimensions may be used, as the plug provided by means of the invention will have other properties than cement and the NORSOK standard may not be relevant for all applications and operations. Any amount of heat generating mixture may be used, dependent on the desired operation, the properties of the heat generating mixture and the materials.

When using a heat generating mixture for removal of a well element, an amount of heat generating mixture is positioned in a well at a desired location. The removal of a well element, or at least parts of a well element, from a well, might be done for numerous reasons, such as to make a window in a tubing or casing for the drilling of a deviated well or to be able to expose the formation, for instance as part of a plug and abandonment operation. Often, during operations including drilling of deviated wells, it might prove difficult to drill through the tubing or casing. The method serves to solve this difficulty by providing an amount of heat generating mixture that is positioned at the desired location, i.e. a melting position where the heat generating mixture is ignited, and create a window in the tubing or casing wall where the deviated well may be drilled.

Alternatively, a heat generating mixture may be positioned to melt a larger area of the tubing or casing, e.g. to melt around the whole circumference of the tubing or casing. This may be practical if the tubing or casing is surrounded by cement or shale that has proved difficult to melt. An option might then be to melt the tubing or casing and expose the cement and or shale. Then the cement or shale may be removed for instance by milling or under-reaming etc., as will be obvious for a person skilled in the art.

The sufficient amount of heat generating mixture needed to remove a well element or at least parts of a well element, will be less than for the well abandonment embodiment because less material is to be melted, and depends on what extent of melting that is desired as well as the material of the well element.

The porosity and density of different heat generating mixtures may vary and thus the weight of the different heat generating mixtures may vary.

The method may further comprise the step of arranging an igniting head in connection with the heat-generating mixture. The igniting head may be suitable for igniting the heat generating mixture.

In an embodiment the method comprises the step of positioning at least one high temperature resistant element close to the melting position in the well. The high temperature resistant element serves to protect parts of the well or well elements that lies above, below and/or contiguous to the melting position. The high temperature resistant element may be made of high temperature resistant materials such as a ceramic element or a glass element. There may be arranged one or more high temperature resistant elements in the well.

In another embodiment the method comprises the steps of positioning the heat generating mixture in a container and lowering the container to the melting position in the well by the use of wire-line or coiled tubing. The desired amount of heat generating mixture is prepared at the surface and positioned in a container. The mixture may for example be a granular or powder mixture. The container may be any container suitable for lowering in to a well. Dependent on the desired operation, the container, or a set of a number of containers, may be a short or a long container. In a P&A operation, where the need of a large melting area is desired, the set of container may be several meters, ranging from 1 meter to 1000 meters.

In an embodiment the method comprises the step of circulating the heat generating mixture to the melting position in the well. The heat generating mixture may be mixed with a fluid, forming a fluid mixture. The fluid mixture may be brought from the surface to the melting position in the well by circulation.

In situations where the well are to be plugged and abandoned, P&A operations, the method may comprise the step of positioning at least one permanent plug in proximity of the melting position in the well and at least one of the high temperature resistant elements above and/or below said permanent plug in the well. The permanent plug serves to seal the well from above or below the melting position, while the high temperature resistant element serves to protect the permanent plug from the heat of the ignited heat generating mixture.

The method may further comprise the steps of positioning at least one high temperature resistant element at least above or below said well element to be removed, and at least above or below said heat generating mixture.

In an alternative embodiment the method comprises the step of arranging a timer in connection with the igniting head. A timer function might be favorable for example in situations where a number of wells are to be abandoned at nearby locations, e.g. from the same template. The timer in each well may be set to ignite at the same time, or at different times, subsequent to that the operation vessel has left the location. This reduces the risk of personal injury.

The heat generating mixture may comprise a thermite mixture, but other heat generating mixtures might be used.

In an embodiment the invention relates to the use of a heat generating mixture for abandoning a well by melting surrounding materials.

Further it is described use of a heat generating mixture for removing a well element which is arranged in a well by melting the well element.

Although various denotations have been used throughout the description, tubing, liner, casing etc. should be understood as pipe or tubular of steel or other metals normally used in well operations.

By the use of the described invention, all operations can be performed from a light well intervention vessel or similar, and the need for a rig is eliminated. Prior to the ignition of the heat generating mixture, the well may be pressure tested to check if the seal is tight. This might be performed by using pressure sensors or other methods of pressure testing known to the person skilled in the art.

The invention will now be described in non-limiting embodiments and with reference to the attached drawings, wherein;

DETAILED DESCRIPTION OF A PREFERENTIAL EMBODIMENT

Figure 1:
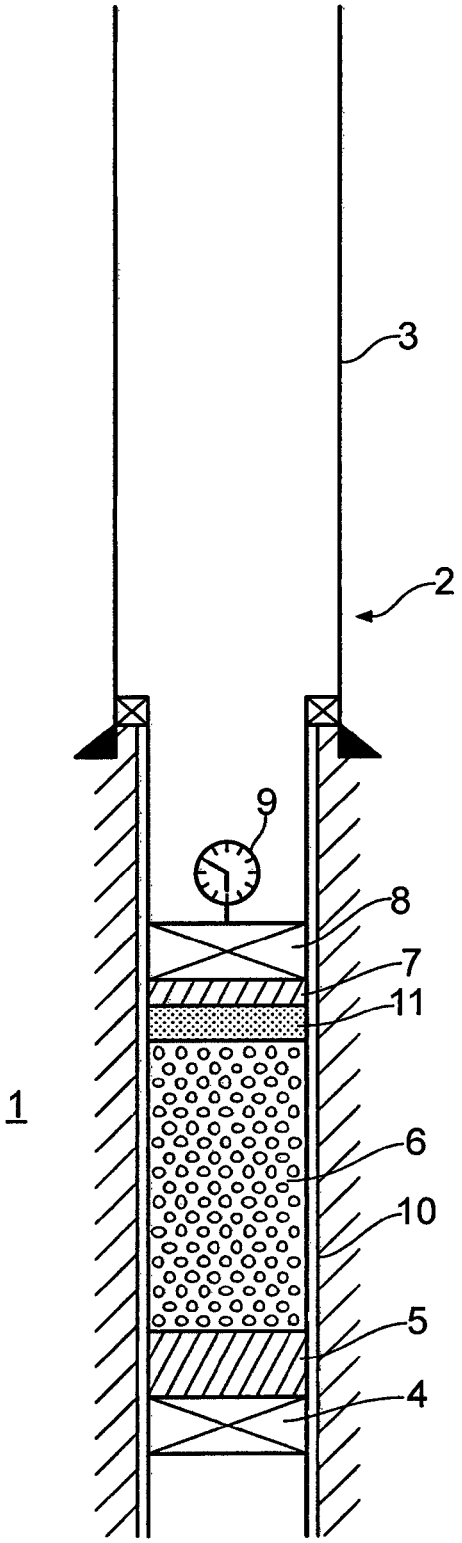
FIG. 1 shows an embodiment of the invention prior to the ignition of the thermite mixture, where the thermite mixture is used for the purpose of well abandonment.

FIG. 1 shows an overview of the invention prior to the ignition of the thermite mixture, where the thermite mixture is used for the purpose of well abandonment. A vertical well 2 has been drilled in a formation 1. The well is provided with casing 3 cemented to the formation wall (not shown), and a tubing or liner 10 in the lowermost part of the well 2. In a lower part of the well a first permanent plug 4 has been set. A first high temperature resistant element 5, such as ceramic element or glass element, is arranged above the first permanent plug 4 to protect the first permanent plug 4. A heat generating mixture, e.g. a thermite mixture 6, is arranged above the first high temperature resistant element 5. Similarly, there may be arranged a second high temperature resistant element 7 as well as a second permanent plug element 8 above the thermite mixture 6. In addition, an igniting head 11, for ignition of the thermite mixture 6, is arranged in connection with the thermite mixture 6. A timer element 9 may be arranged to time set the detonation of the igniting head 11, and thus the thermite mixture 6.

Figure 2:
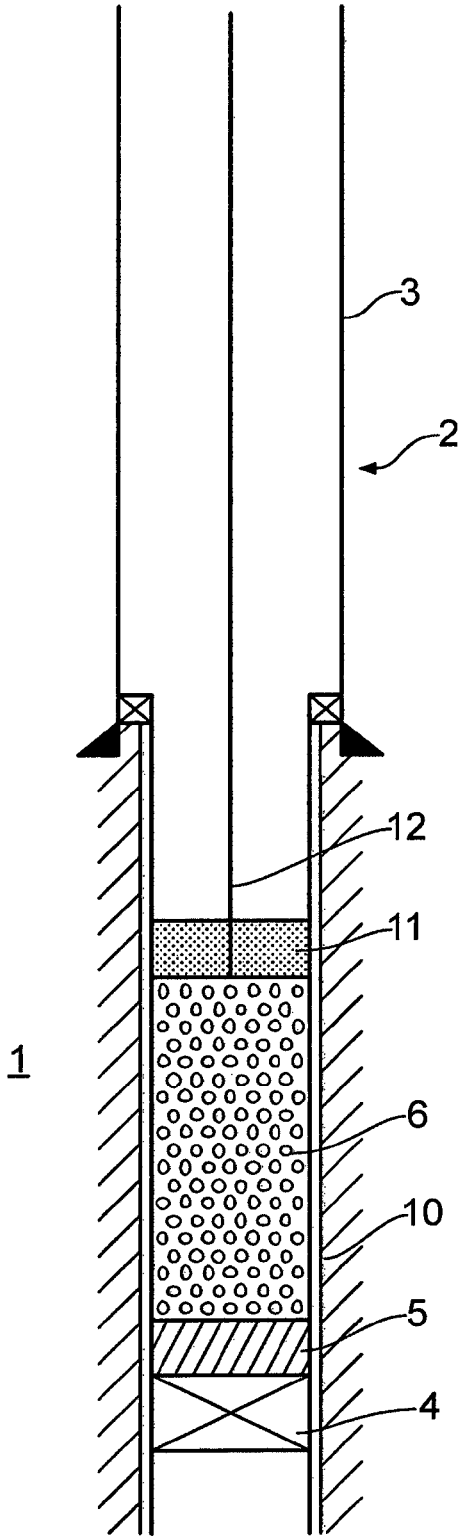
FIG. 2 shows an alternative embodiment of FIG. 1.

FIG. 2 shows an alternative embodiment to the embodiment shown in FIG. 1, again prior to the ignition of the thermite mixture. As shown in FIG. 1, a vertical well 2 has been drilled in a formation 1. The well is provided with casing 3 cemented to the formation wall, and a tubing or liner 10 in the lowermost part of the well 2. In a lower part of the well a first permanent plug 4 has been set. A first high temperature resistant element 5, such as ceramic element or glass element, is arranged above the first permanent plug 4 in order to protect the first permanent plug 4. A thermite mixture 6 is arranged above the first high temperature resistant element 5. An igniting head 11 is arranged in connection with the thermite mixture. Additionally, there is arranged a lowering tool 12, such as a wire-line tool, for the lowering of the at least one of the first permanent plug 4, the first high temperature resistant element 5, the thermite mixture 6 or the igniting head 11.

Figure 3:
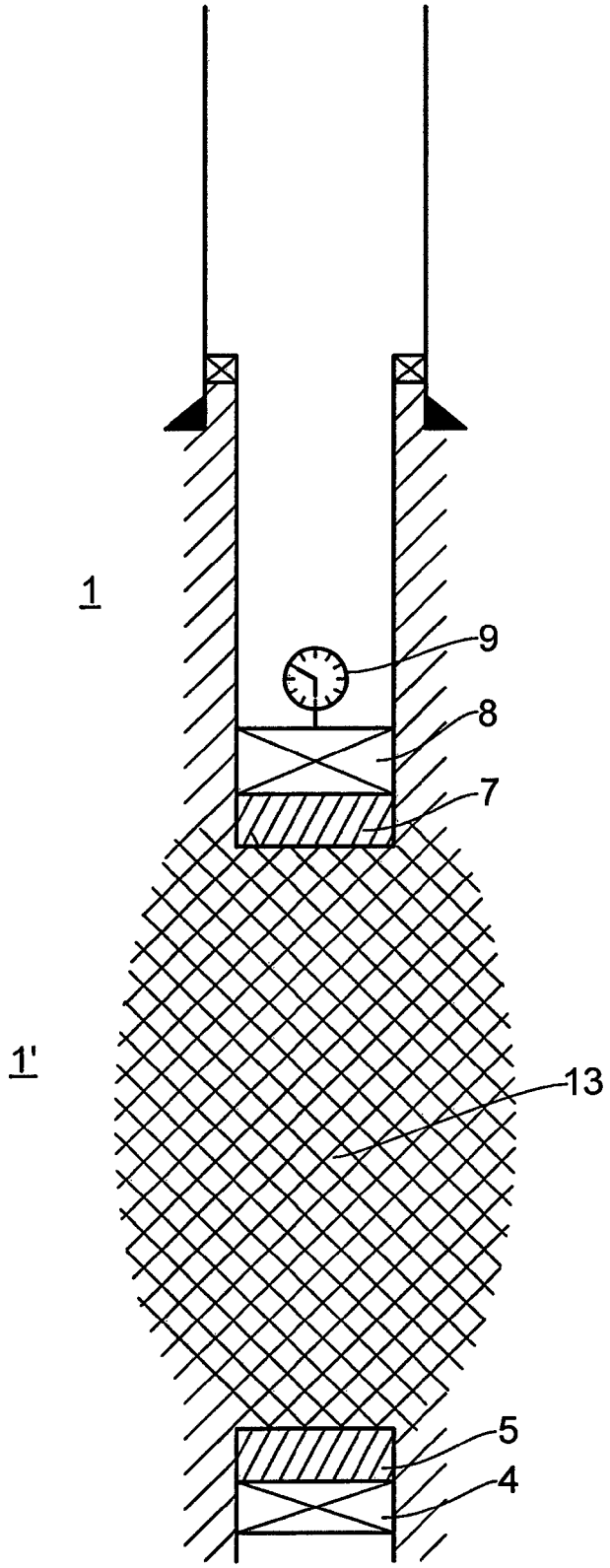
FIG. 3 shows the embodiment of FIG. 1 after the ignition of the thermite mixture.

FIG. 3 shows the embodiment of FIG. 1 after the ignition of the thermite mixture. The part of the formation showed with reference numeral 1 has not been subject to influence by the heat from the thermite mixture, while the formation area 1' has been influenced by the heat.

Element 13 on FIG. 3 refers to the melted area, i.e. the area that has been influenced by the heat from the thermite mixture for instance pipe, cement, thermite mixture canister, formation sand etc. As seen in the FIG. 3, the first permanent plug element 4 is intact after the ignition of the thermite mixture. This is due to that the first permanent plug 4 has been protected from the heat by the first high temperature resistant element 5. Similarly, the second permanent plug 8 and the timer 9 are also intact as they have been protected from the heat by the second high temperature resistant element 7.

An example of operation of abandoning a well, see FIG. 1 and FIG. 3, may include positioning a first permanent plug 4 in a vertical well 2. The first permanent plug 4 serves to close off the well below said plug 4. Then positioning of a first high temperature resistant element 5 above said plug 4 in the well 2 and tubing 10. When the first high temperature resistant element 5 is in place, lowering a thermite mixture 6 and igniting head 11 to said first high temperature resistant element 5. Arranging a second high temperature resistant element 7 above said thermite mixture 6 and igniting head 11. Positioning of a second permanent plug 8 above said second high temperature resistant element 7, and, if desirable, connecting a timer 9 to the igniting head 11. The ignition of the thermite mixture 6 by the igniting head 11 results in, see FIG. 3, that the part of the well 2, including cement, pipe, formation sand etc. between the first high temperature resistant element 5 and the second high temperature resistant element 7 melts due to the heat (~3000° C.), which is shown by reference numerals 1' and 13. The melted cement, pipe, formation sand etc. forms a permanent seal of the formation 1.

Figure 4:
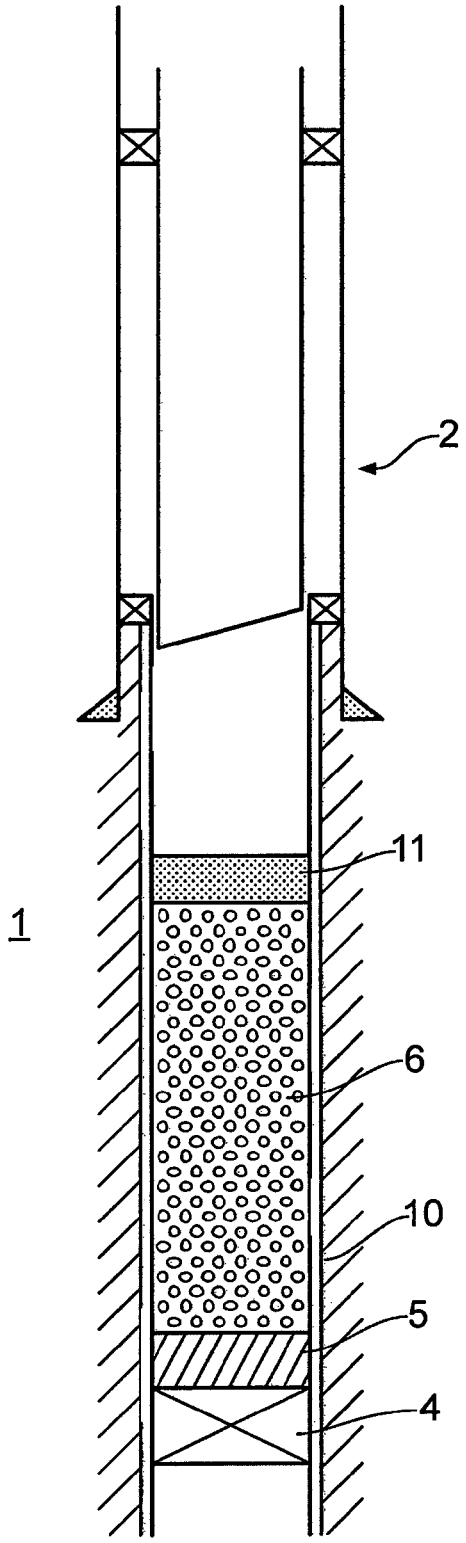
FIG. 4 shows an embodiment of the invention prior to the ignition of the thermite mixture where the thermite mixture is used for removing a well element.

FIG. 4 shows an example prior to the ignition of the thermite mixture where the thermite mixture is used for the removal of a well element. A well 2 has been drilled in a formation 1. The vertical well 2 is provided with casing 3 cemented to the formation wall, and a tubing or liner 10 in the lowermost part of the well 2. In a lower part of the well a first permanent plug 4 has been set. A first high temperature resistant element 5, such as ceramic element or glass element, is arranged above the first permanent plug 4 to protect the first permanent plug 4. A thermite mixture 6 is arranged above the first high temperature resistant element 5 arranged in connection with an igniting head 11.

Figure 5:
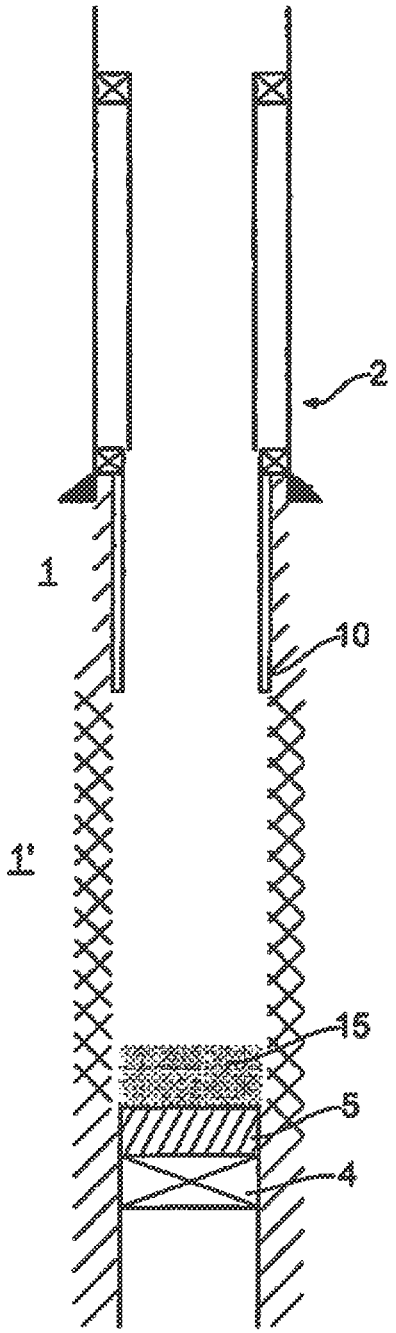
FIG. 5 shows the embodiment of FIG. 4 after the ignition of the thermite mixture.

FIG. 5 shows the embodiment of FIG. 4 after the ignition of the thermite mixture, where parts of a pipe 10 has been removed. The part of the formation showed with reference numeral 1 has not been subject to influence by the heat from the thermite mixture, while the formation area 1' has been influenced by the heat.

Reference numeral 15 refers to the melted material gathered above the first high temperature resistant element 5, i.e. the material that has been influenced by the heat from the thermite mixture for instance pipe, cement, thermite mixture canister, formation sand etc. As is seen in the figure, the first permanent plug element 4 is intact after the ignition of the thermite mixture 6. This is due to that the first permanent plug 4 has been protected from the heat by the first high temperature resistant element 5. In the shown embodiment parts of the pipe 10 has been removed by melting. Although it is shown that the whole circumference of a pipe has been melted, it is also possible to melt only parts of a pipe, such as to form a window in the pipe etc.

The operation of the thermite mixture for removal of parts of a well element, cf. FIG. 4 and FIG. 5, is similar to the method described above for the well abandonment operation. The only difference is the amount of thermite mixture used.

By the arrangement of the embodiments of the figures a proposed solution to the object of the invention is explained, which is to provide a method for permanent well abandonment by the use of a heat generating mixture.

The invention is herein described in non-limiting embodiments. It should though be understood that the embodiments shown in FIGS. 1-5 may be envisaged with a lower or higher number of permanent plugs and high temperature resistant elements. The skilled person will understand if it is desirable to set none, one, two or several permanent plugs dependent on the desired operation. Similarly, the number of high temperature resistant elements positioned in the well may vary from zero, one, two or several, dependent on the operation.

The invention claimed is:

1. A method of well abandonment, the method comprising melting surrounding materials of a well, the well being formed in a well formation, and wherein the melting comprises;

providing an amount of a heat generating mixture;

positioning the heat generating mixture at a melting position in the well;

positioning at least one high temperature resistant element in the well; and igniting the heat generating mixture thereby forming a solidified plug extending across a full cross sectional area of the well and against the well formation by melting the surrounding materials of the well to abandon the well, and wherein the at least one high temperature resistant element divides and protects parts of the well that lies above, below and/or contiguous to the melting position from heat generated by the heat generating mixture upon igniting, wherein the surrounding materials of the well are selected from the group consisting of tubulars, casings, liners, cement, pipe, formation sand, and combinations thereof.

2. The method according to claim 1, further comprising arranging an igniting head in connection with the heat generating mixture.

3. The method according to claim 2, further comprising arranging a timer in connection with the igniting head.

4. The method according to claim 1, further comprising positioning the heat generating mixture in a container and lowering the container to the melting position in the well by the use of wire-line or coiled tubing.

5. The method according to claim 4, further comprising positioning at least one first plug in proximity of the melting position in the well and the at least one high temperature resistant element above and/or below said at least one first plug in the well.

6. The method according to claim 1, further comprising circulating the heat generating mixture to the melting position in the well.

7. The method according to claim 1, wherein the heat generating mixture is a material that produces an exothermic reaction.

8. The method according to claim 1, wherein the heat generating mixture comprises a thermite mixture.

9. The method according to claim 1, wherein the solidified plug comprises solidified surrounding materials of the well.

10. The method according to claim 1, wherein forming a solidified plug against the well formation by melting the surrounding materials of the well comprises removing at least a portion of a well element, the well element selected from the group consisting of a tubular, a liner or a pipe.

* * * * *